US005150499A

United States Patent [19]

Berfield

[11] Patent Number: 5,150,499

[45] Date of Patent: Sep. 29, 1992

[54] STATIC ELECTRIC DISCHARGE FOR DUST COLLECTOR

[75] Inventor: Robert C. Berfield, Jersey Shore, Pa.

[73] Assignee: Shop Vac Corporation, Williamsport, Pa.

[21] Appl. No.: 614,711

[22] Filed: Nov. 16, 1990

[51] Int. Cl.[5] ..... H05F 3/02

[52] U.S. Cl. ..... 15/327.1; 15/339; 361/212; 361/220

[58] Field of Search ..... 15/339, 377, 327.1, 15/327.7; 174/47; 361/212, 215, 220, 221, 222; 285/7

[56] References Cited

U.S. PATENT DOCUMENTS 4,597,130 7/1986 Lyman ..... 15/339
4,697,300 10/1987 Warlop ..... 15/339
4,866,565 9/1989 Wray, Jr. ..... 15/339
4,912,593 3/1990 Iwao et al. ..... 361/212

*Primary Examiner*—Harvey C. Hornsby
*Assistant Examiner*—Reginald L. Alexander
*Attorney, Agent, or Firm*—Ostrolenk, Faber, Gerb & Soffen

[57] ABSTRACT

An anti-static dust collector includes a tank and an electrically non-conductive flexible hose, both of which are susceptible to the build-up of static electric charge. To remove such charge from the hose, the hose includes a helical wire which is connected to the grounding terminal of the electrical power plug used to supply electric power to the dust collector. Where the housing of the vacuum cleaner is electrically non-conductive, accumulation of electrostatic charge from the housing is removed by a metallic strap connected to the interior of the housing and also electrically connected to the grounding terminal of the power plug.

17 Claims, 5 Drawing Sheets

2
16
17
67
18
24
19
53
12
25
48
49
51
52
10
28
2
48a
46
26
47a
13
47
18
44
43

54
18
53
56
62
61
51
58
59

FIG. 8.
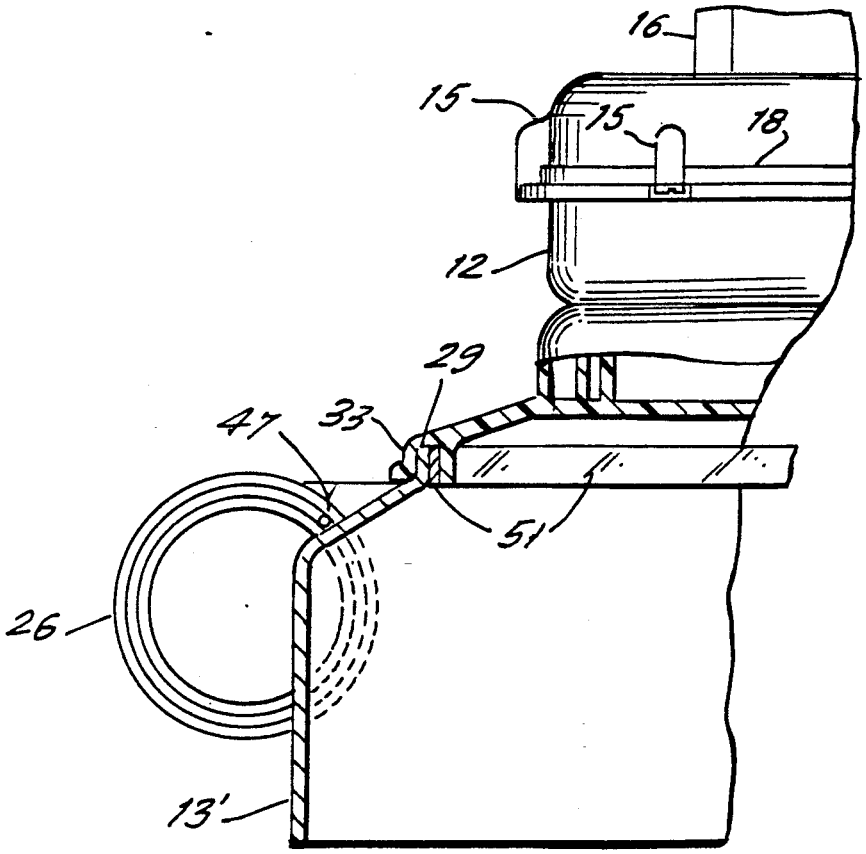
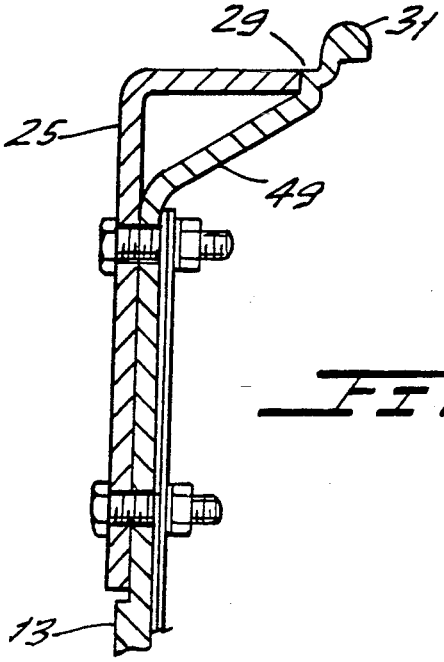
FIG. 6.

STATIC ELECTRIC DISCHARGE FOR DUST COLLECTOR

BACKGROUND OF THE INVENTION

1. Field of the Invention

The present invention relates to dust collectors, which are a type of vacuum cleaner and, more particularly, relates to means for eliminating accumulated electrostatic charges which are developed during suctioning of dust and dirt.

2. Description of the Prior Art

As dirt and dust filled air moves through a dust collector or vacuum cleaner, electrostatic charges tend to build up on non-electric components of the dust collector, particularly the suction inlet hose and the dirt collection tank. Such accumulated charges, if not relieved, could produce electric shock to users of the dust collector or damage sensitive electrical equipment in the vicinity of the dust collector. Additionally, where the dust collector is used in an environment subject to an explosive gas mixture, the buildup of electrostatic charges could result in an explosion.

Various techniques have been used in the prior art to prevent or relieve electrostatic charge build-up on parts of a dust collector. For example, the charge may be directed to another part of the dust collector where the charge is dissipated by discharge to the surrounding air. Unfortunately, such discharge may still adversely affect sensitive electrical equipment or, if used in an explosive atmosphere, may still cause an explosion. Additionally, although such techniques tend to discharge the built up electrostatic charge in areas of minimal danger to the user, such danger is not entirely eliminated.

Other prior art suggests applying an electric conductor to the surface of a vacuum cleaner component on which electrostatic charge develops for draining that charge from the surface to a ground potential. For example, a wire in the intake hose conducts charge to ground in U.S. Pat. Nos. 4,715,085; 4,866,565; 2,047,216; and 4,697,300. But, these references do not suggest a convenient way to drain the charge to ground in a tank type dust collector and especially where the drain to ground is in a separable lid over a tank, while the tank and the inlet hose to the tank develop the charge to be drained.

SUMMARY OF THE INVENTION

It is an object of the present invention to provide a dust collector or vacuum cleaner in which electrostatic charge or static electricity on surfaces of the components is eliminated while avoiding discharge of electrostatic charge in or around the dust collector and which is, therefore, safe to both the user and to any surrounding equipment.

Another object of the invention is to drain electrostatic charge from dust collector components where the electrostatic charge drain is located in the separable lid above the components which develop the charge.

The foregoing and other objects are accomplished by a dust collector or a vacuum cleaner which includes a housing or tank having an internal collecting chamber, an air inlet duct communicating into the chamber and an inlet hose on the duct. Suction means, such as a fan operated by an electric motor, suck air from within the tank chamber to produce a low pressure there, i.e. a partial vacuum. The suction means, e.g. a blow motor with a fan, is in a housing on a lid that is separably attached on the tank. Electrical connecting means, including a grounding element, are provided for connecting the suction means, i.e. the motor, to a source of electric power including a source of ground potential.

An electrically non-conductive, e.g. plastic intake hose is connected to the air inlet duct of the tank. As the air and dirt are sucked through the hose, the hose is susceptible to a build-up of electrostatic charge. To remove that charge, the hose has an electrically conductive element associated with it. In a preferred embodiment, the electrically conductive element is a length of wire extending along the hose, and particularly helical wire wound around the inside of the hose, substantially coextensive in axial length with the hose. Although a bare, uninsulated wire might be preferable, even an insulated wire may be used effectively when the insulation is minimal enough, because the static electricity finds a lower resistance path to the wire than to the outside of the non-conduction hose.

Typically, the hose communicates into a tank inlet duct located in the tank wall. The tank inlet could be in the lid also, but then the improvement of the invention is not required for the intake hose. Means are provided for electrically connecting the hose conductive element in the hose to the grounding element of the electrical connecting means in the lid so that when the electrical connecting means is connected to the source of electric power, the hose conductive element is grounded to provide a path to drain or bleed off any electrostatic charge which may build-up on the hose as air passes through it.

The housing or tank may be formed of an electrically non-conductive material or plastic. The tank may develop electrostatic charge as the air and collected dust and dirt move over its interior surface. To remove this charge, another electrically conductive element extends along the tank and particularly down the internal surface of the tank. Means are also provided for electrically connecting the tank conductive element to the grounding element in the lid to discharge the tank similarly to the discharge of the hose.

If the tank inlet is in the tank wall, both the hose conductive element and the tank conductive element are connected to the ground element through an electric contact in the tank which contacts an electric contact in the lid. The contact in the lid is a conductive interface element, in the form of a ring around the lid at the interface where the lid is seated on the tank. If the tank inlet is in the lid, only the tank conductive element would be connected through the interface element to the grounding element. The ring shape of the interface element enables electric contact between the tank and lid contacts regardless of the orientation or position of the lid relative to the tank. Other means for accomplishing that function may be envisioned.

BRIEF DESCRIPTION OF THE DRAWINGS

The invention, its objects, advantages and features will be better understood from the following detailed description, when considered in connection with the accompanying drawings, in which:

FIG. 6 is a cross-sectional view taken along the line 6—6 of FIG. 5;

FIG. 8 is an elevational view, with portions removed for clarity of an alternative embodiment of the tank of the dust collector of FIGS. 1-6.

DESCRIPTION OF PREFERRED EMBODIMENTS

Figure 1:
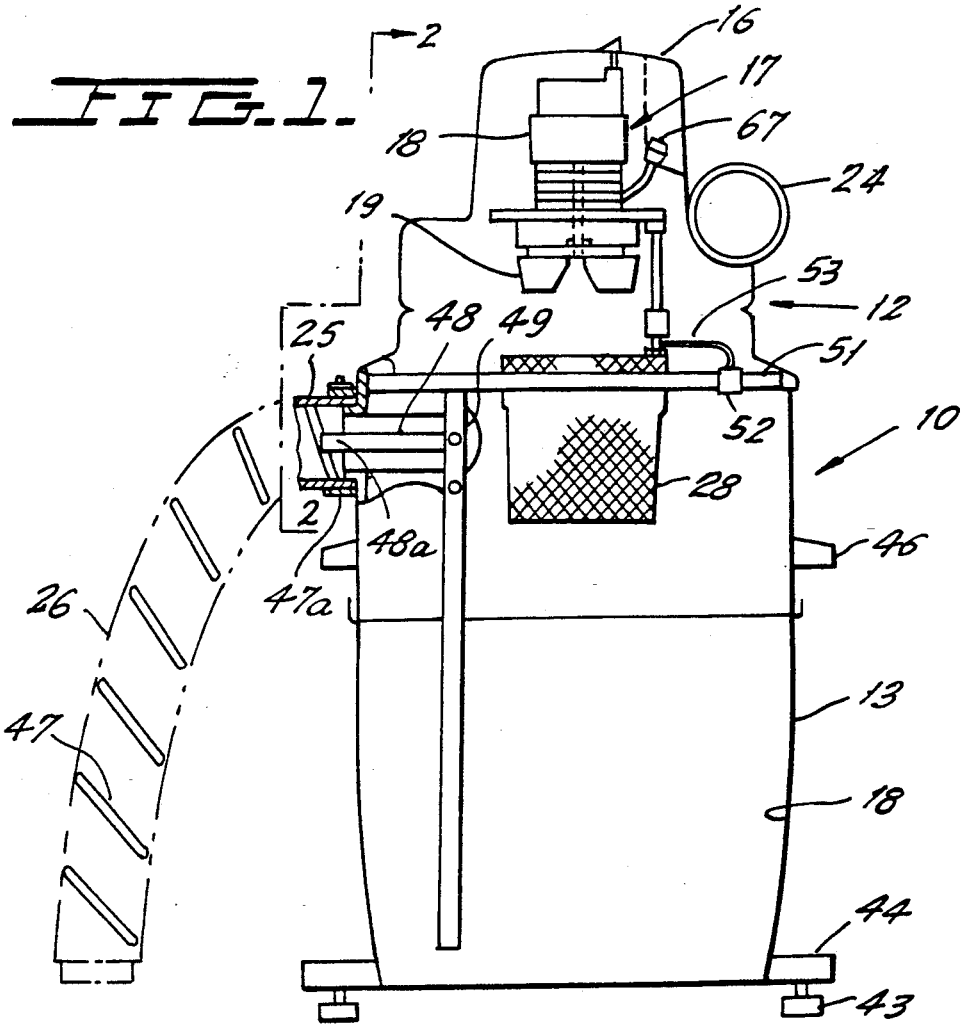
FIG. 1 is an elevational view, with portions removed for clarity, of a dust collector or vacuum cleaner illustrating features of a first embodiment of the present invention.
Figure 2:
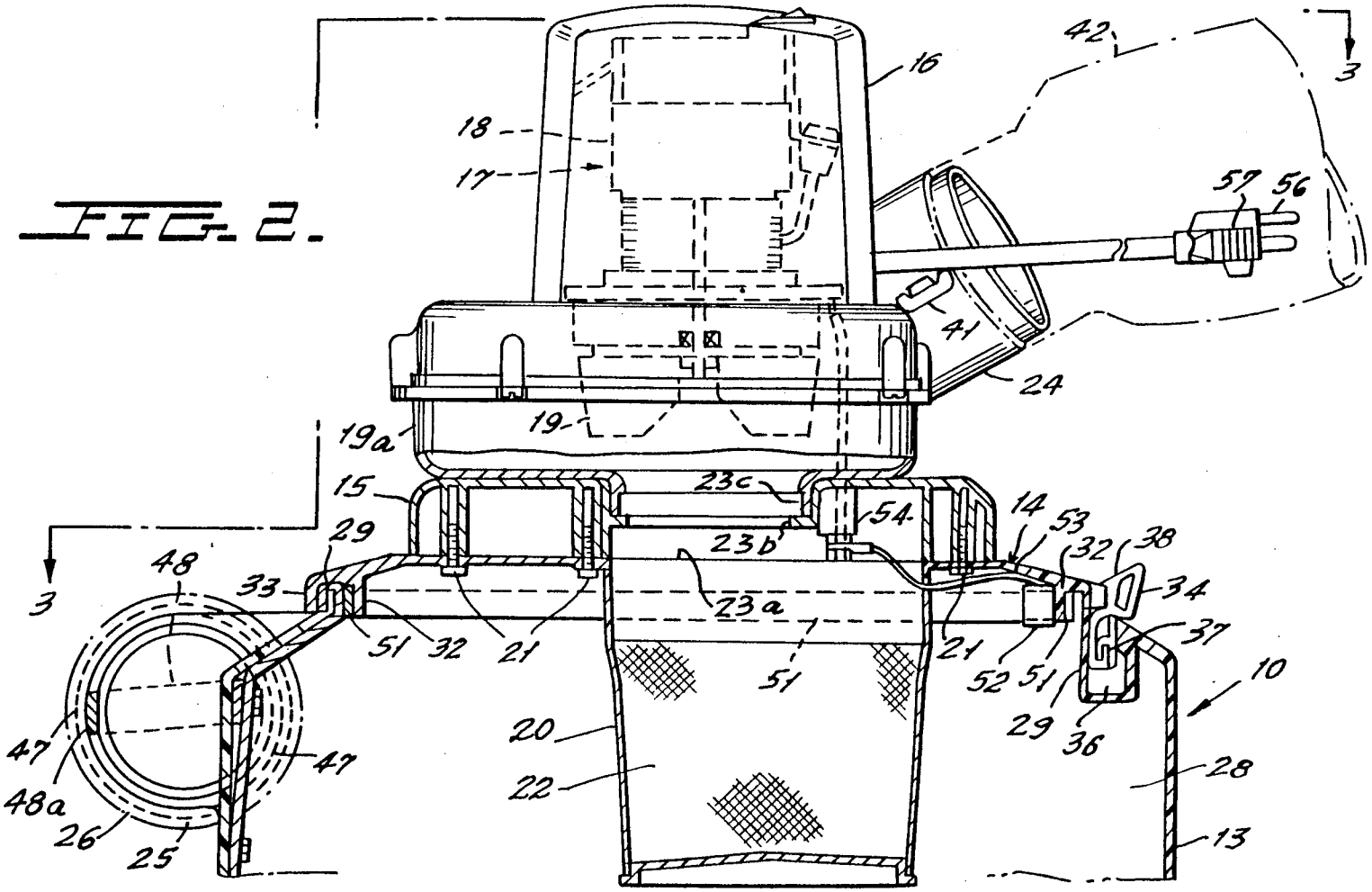
FIG. 2 is an enlarged, fragmentary view taken along the line 2—2 of FIG. 1.

FIGS. 1 and 2 show a dust collector 10, in the form of a vacuum cleaner, which includes the present invention. The dust collector 10 includes a dust and dirt collection housing or tank 13 on which a lid 12 is attachably seated.

The lid 12 includes an outwardly extending plate 14 for closing the open top end of the tank 13, an outlet and fan housing support crown 15 on the plate 14 and an upwardly extending, blow motor housing 16 for a suction or vacuum generating unit 17, which conventionally includes an electric blow motor 18 and a centrifugal fan 19 driven by the motor. The fan 19 sucks air from the tank 13 and blows the air around the generally toroidal outlet chamber 19*a* around the fan and through the outlet duct 24.

The housing 16, the lid crown 15, and the outlet chamber 19*a* are connected to the lid plate 14 by suitable fasteners 21.

Depending from the lid crown 15 is a generally cylindrical, but slightly tapering width, filter support cage 20, which is adapted to receive a suitable annular, cuff shaped, replaceable, porous dust collecting filter 22. The filter 22 is in the form of a generally cylindrical sleeve which may be easily slipped over the cage 20 from below to install the filter and which may later be slipped off for cleaning or replacement. The filter support cage 20 communicates with the fan 19 supported above the cage via aligned openings 23*a* in the lid plate 14, 23*b* in the top wall of the crown 15 and 23*c* at the bottom of the outlet chamber and fan housing 19*a* formed in the bottom portion of the fan housing 16. When the suction unit 17 is operated, air is drawn into the fan housing 16 through the tank 13 and through the filter 22 and is reexhausted by the fan through an outlet duct 24 formed in a side wall of the housing 16.

Figure 4:
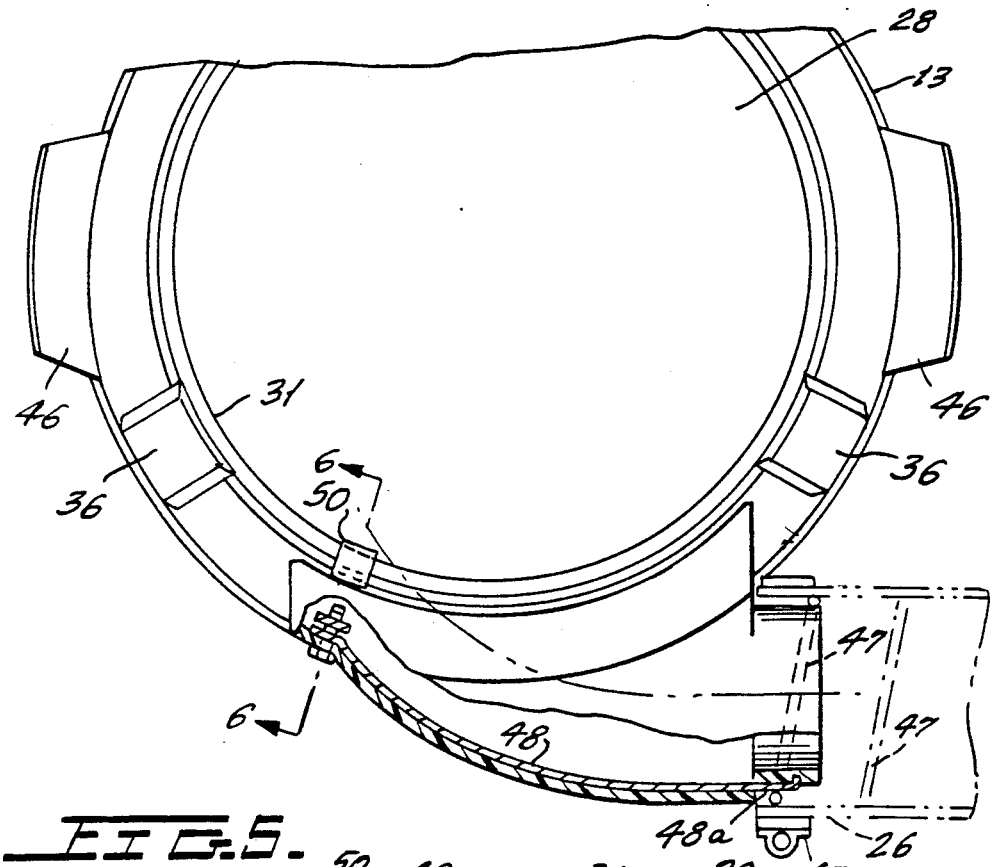
FIG. 4 is a plan view of the tank part of the dust collector illustrated in FIGS. 1-3.

As seen in FIG. 4, the tank 13 includes an air inlet duct 25 to which a flexible intake hose 26 is attachable. The inlet duct 25 communicates with the tank interior 28 through an opening 27 (FIG. 1) in the sidewall of the tank. The opening 27 is the only inlet to the tank, whereby the fan 19 sucks air into the tank through the opening 27.

Figure 5:
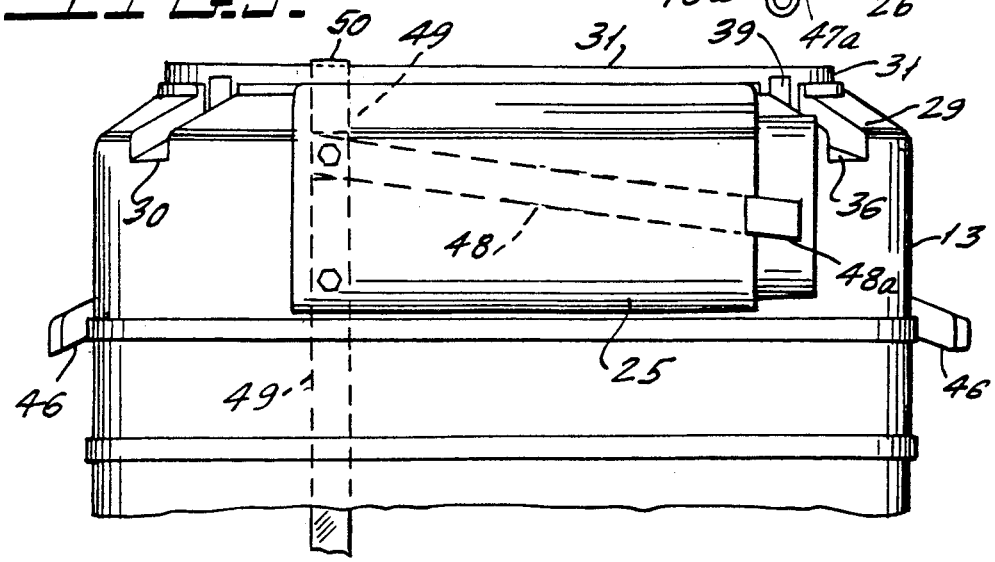
FIG. 5 is a view taken along the line 5—5 of FIG. 4, with portions removed for clarity.

As seen in FIG. 5, at its top, the tank 13 includes a sidewall 29 which extends upwardly to a rim 31. Referring to FIG. 2, the plate 14 of the lid 12 is sized and shaped so as to seat upon the tank wall 29, 31. The bottom of the plate 14 of the lid 12 has a radially inner depending flange 32 and a radially outer depending flange 33, which flanges are spaced so as to bracket and closely fit about the upstanding sidewall 29 of the tank 13 to seal the lid 12 to the tank. To secure the lid 12 to the tank 13 and make the seal therebetween, the lid includes a plurality of pivotally operated clamp elements 34 (only one of which is shown) which fit into recesses 36 formed about the circumference of the tank beneath the rim 29. The clamps 34 are pivotally mounted at their lower ends 37 so as to pivot inwardly. The upper end 38 of each clamp 34 is shaped to hook under a lip 39 formed in the rim 29 at each recess 36.

The outlet duct 24 includes a pair of hooks 41 at opposite sides of the duct 41 to enable a dust collection bag 42 to be attached onto the outlet from the duct 41.

To ease movement of the tank 13 over a floor, the tank includes caster wheels 43 mounted to respective support flanges 44 at the bottom of the tank. The tank 13 also includes a pair of handles 46 to ease movement and emptying of the tank.

When the suction unit 17 is operating, dust laden air is drawn into the tank chamber 28 through the hose 26 and the inlet duct 25, 27. The heavier dust and particles and most of the collected material falls to the bottom of the chamber 28 of the tank. But, the finer, lighter dust moves toward the fan, where most of it is trapped by the filter 22. Very small particles pass through the filter 22 and the outlet duct 24 and are collected by the bag 42.

The hose 26, lid 12 and the tank 13 are all made of suitable light, strong and durable materials, e.g. plastic. They are non-metallic, and electrically non-conductive. More specifically, the hose 26 is preferably made of polyethylene and the lid 12 and the tank 13 are preferably made of polypropylene. As air carrying dirt and dust is moved through the hose and around the inside of the tank and lid, the friction between the dust collector parts and the particulate matter produces electrostatic charges on the hose 26 and the tank 13. The charge build-up on the hose 26 could be particularly dangerous since the hose is held during use and the hose is generally in contact with or adjacent to other equipment. Charge buildup in the hose 26 should be avoided so that the user is not shocked and so that sensitive electrical equipment in the vicinity is not damaged.

In the present invention, electrostatic charge on the hose 26 is drained off by placing an electrically conductive element in association with the non-conductive hose to provide a discharge path. In the preferred embodiment, the hose conductive element comprises a helical wire 47 (FIG. 1) coiled inside of and in contact with the hose. The wire may be bare or exposed over its length. However, even if it is insulated, so long as the insulation layer is thin enough, the static electricity will travel to the wire, rather than along the outside of the non-conduction hose 26. If the hose is internally corrugated, the wire can follow along the corrugations. The wire can perform an additional function of giving the hose its round shape and of stiffening it and may also define the corrugations in the hose. To drain the charge which develops anywhere along the hose 26, the wire 47 extends over the axial length of the hose. The hose 26 is installed by placing its outlet end over and around the inlet duct 25. The final coil or coils at the end of the conductive wire 47 contact the contacting end 48*a* of a first conductive metallic strap 48 which is attached to and extends along the outside of the entrance end of the inlet duct 25. A standard tightenable, e.g. turnbuckle type, clamping ring wraps over the outside of the end of the hose and clamps the wire securely against the strap end 48*a*, making electric contact between them, and breaking the insulation layer over the wire to permit direct wire to strap electric contact. The strap 48 continues along the inner periphery of the duct 25 to the inside of the tank chamber 28. Inside the tank chamber 28, the strap 48 is connected to another bare, exposed conductive metallic strap 49 which is attached along its full length to the inner surface of the tank chamber 28. As seen in FIG. 6, the strap 49 extends vertically to and over the rim 31 of the tank 13 and defines a tank contact 50. The strap 49 extends down along the wall of the tank nearly to the bottom of the tank.

The straps 48 and 49 bring the charge into the tank. The charge must be transferred to the lid and to ground through the motor. Electric contacts at the straps 48 and 49 and on the lid effect that transfer.

Referring to FIGS. 1 and 2, the lid 12 includes a lid contact in the form of an encircling bare, exposed metal ring 51 disposed around and on the radially inside of the depending inner flange 32. When the lid 12 is seated on the tank 13, the ring 51 contacts the tank contact 50 which is part of the strap 49 on the tank. To assure the electric contact, the strap 49 terminates in a tank contact in the form of a clip 50 that is clipped over the tank rim 31. The clip 50 is bracketed by the lid flanges 32 and 33 and touched by the ring 51 on the flange 32. Because the ring 51 completely encircles the lid, ring 51 to strap 49 contact occurs regardless of the rotative orientation of the lid relative to the tank. This establishes an electric circuit running from the wire 47 in the hose to the metal ring 51 via the straps 48 and 49.

Figure 7:
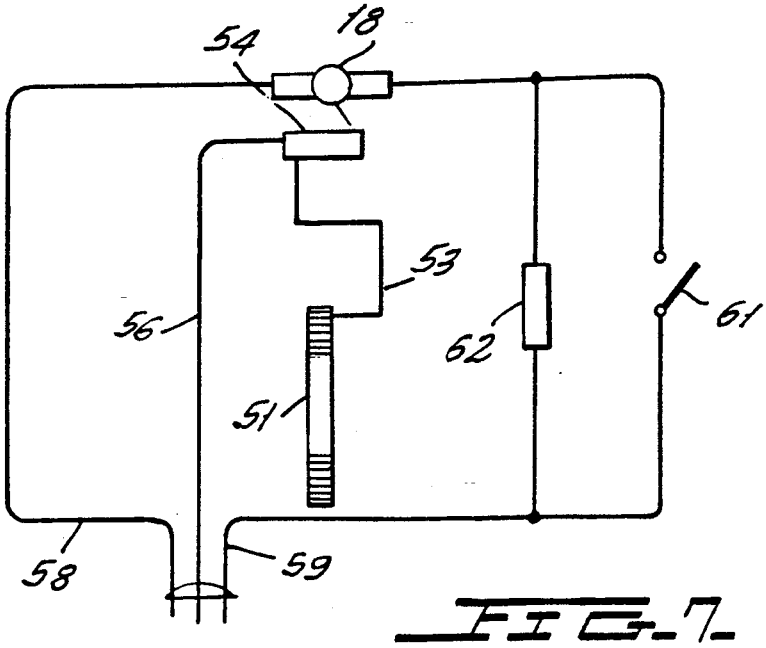
FIG. 7 is a schematic electric circuit diagram illustrating the interconnection of the electric components of the dust collector of FIGS. 1-6.
Figure 3:
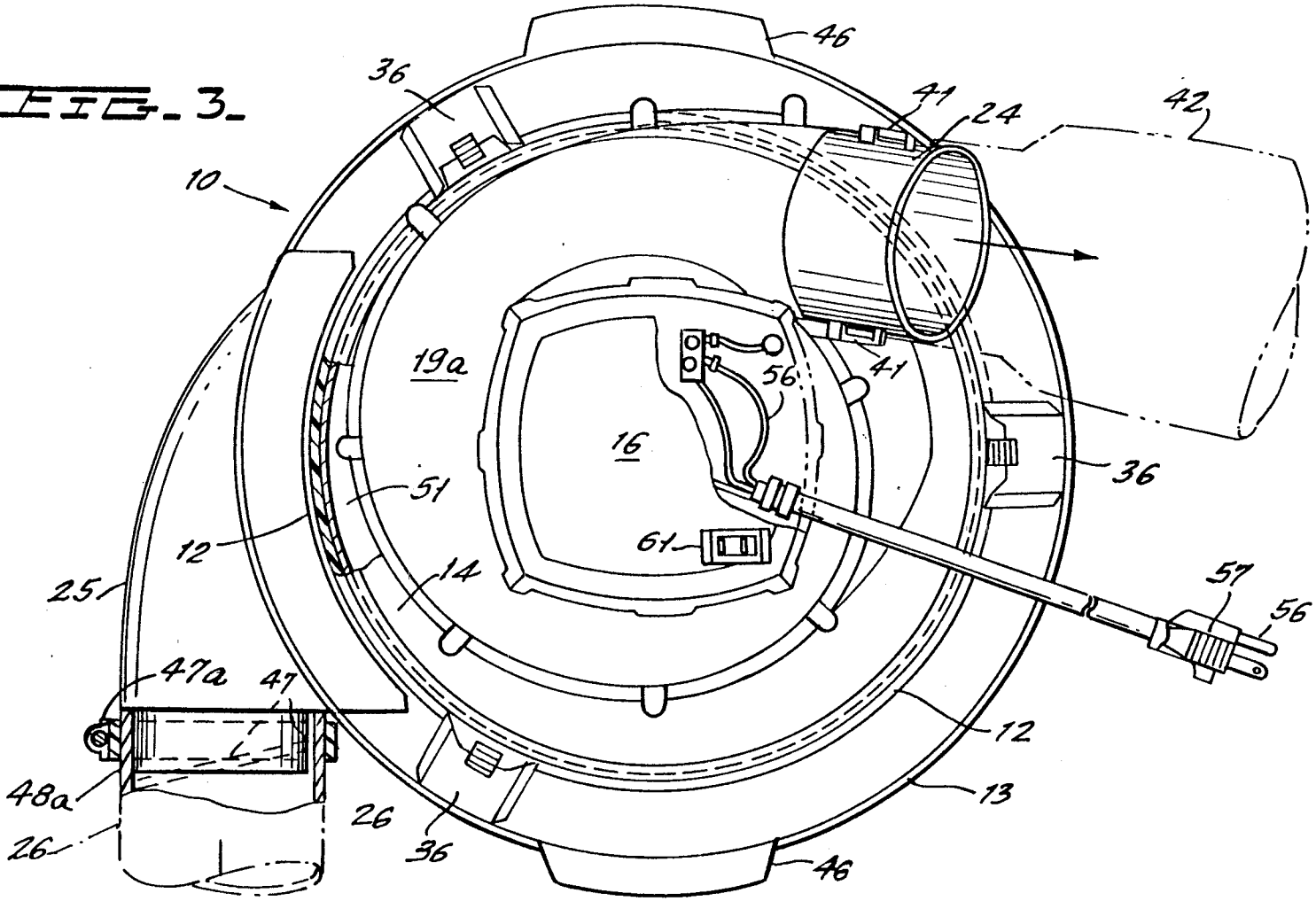
FIG. 3 is a view taken along the line 3—3 of FIG. 2, with portions broken away for clarity.

The conductive ring 51 is secured to the lid flange 32 by a plurality of spaced apart metal clips 52. One clip 52 has an electric lead 53 attached to it by soldering, for example. Referring to FIGS. 3 and 7, the other end of the lead 53 is connected to a terminal block 54 located beneath the tank lid 12. From terminal block 54, the lead 53 is connected to the ground lead 56 of a three-prong A/C power plug 57. One power lead 58 of the plug 57 is connected directly to the motor 18 and the other power lead 59 is connected through an on/off switch 61 to the motor. An electrical receptacle 62 is provided for maintenance purposes. Additionally, the motor 18 is also connected to the ground terminal 56 of the plug 57.

Whenever the plug 57 is inserted into a suitable three-prong receptacle for A/C power, the lead 56 is grounded. As a result, ground potential is applied to the metal ring 51 and from the ring through the straps 48 and 49 to the wire 47 in the hose 26 and to the tank wall, thereby providing a low resistance path for any charge that develops as air passes through the hose and the tank. Charge accumulation is prevented since any charge that is developed immediately drains to the wire 47 which is at ground potential.

Because of movement of the dust-laden air within the chamber 28, an electrostatic charge tends to build up on the non-metallic tank 13. This charge is dissipated by the strap 49 vertically extended downward so that it extends almost the entire height of the tank 13 along its wall. Any charge that tends to build up on the tank 13 migrates to the strap 49 from which it is then drained through the ring 51 to the ground established through the plug 57.

In lieu of an electrically non-conductive tank 13, as shown in FIG. 8, a tank 13' of metal may be employed. In this case, the helical wire 47 is still connected to a conductive strap 48, as in the first embodiment. But the strap is connected directly to the tank 13'. Additionally, since the tank 13' is conductive, the tank strap 49 is not necessary.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dust collector comprising:

a dust collecting tank having an internal chamber, an open top and an air inlet duct into the tank chamber;

a separable lid attached to the tank over the open top;

suction means, supported on the lid, responsive to electrical power for generating reduced air pressure within the chamber;

first electrical connecting means, including a grounding element, for connecting the suction means to a source of electric power including a source of ground potential;

an electrically non-conductive hose having an outlet end connecting to the air inlet duct and having an inlet end through which air may be drawn into the hose when reduced air pressure is generated within the chamber;

an electrically conductive element extending along and contacting the hose and providing a low resistance path to any electrostatic charge which may develop on the hose; and second electrical connecting means for connecting the electrically conductive element to the ground element of the first electrical connecting means, the second electrical connecting means comprising a tank contact on the tank electrically connectable with the electrically conductive element, the tank contact including a first metallic strap at the inlet duct to the tank and a lid contact on the lip connected with the grounding element, and arranged for engaging the first metallic strap regardless of the orientation of the lid when the lid is on the tank to thereby assure electrical contact between the tank contact and the ground element.

2. The dust collector of claim 1, wherein the conductive element is inside and in contact with the interior of the hose along the length of the conductive element.

3. The dust collector of claim 1, in which the first conductive element is a flexible helical electrical wire in contact with the hose along the length of the wire and of the hose.

4. The dust collector of claim 3, wherein the wire is insulated.

5. The dust collector of claim 1, in which the tank inlet duct is comprised of an electrically non-conductive material, the second electric connecting means includes a first metallic strap at the inlet duct to the tank; the helical wire is electrically connectable to the first strap.

6. The dust collector of claim 5, in which the tank is also of non-conductive material, and a second conductive strap extends along the tank to provide a low resistance path for any electrostatic charges which may build up on the tank, and the second strap is connected to the connecting means.

7. The dust collector of claim 1, wherein the inlet duct is formed in the tank.

8. The dust collector of claim 1, in which the tank has an upper rim which defines the open top, the lid has a lower rim mateable with the upper rim of the tank for sealing the lid to the tank.

9. The dust collector of claim 8, wherein the tank contact is on the upper rim and the lid contact is on the lower rim.

10. The dust collector of claim 1, in which the tank inlet duct is comprised of an electrically non-conductive material, the second electrical connecting means includes a first metallic strap at the inlet duct to the tank; the conductive element includes a helical wire electrically connectable to the first strap; and the first metallic strap includes the tank contact on it.

11. A dust collector comprising:

a dust collecting tank having an internal chamber, an open top and an air inlet duct into the tank chamber, the tank inlet duct being comprised of an electrically non-conductive material;

a separable lid attached to the tank over the open top;

suction means, supported on the lid, responsive to electrical power for generating reduced air pressure within the chamber;

first electrical connecting means, including a grounding element, for connecting the suction means to a source of electric power including a source of ground potential;

an electrically non-conductive hose having an outlet end connecting to the air inlet duct and having an inlet end through which air may be drawn into the hose when reduced air pressure is generated within the chamber;

an electrical conductive element in the form of a helical wire extending along and contacting the hose and providing a low resistance path to any electrostatic charge which may develop to the hose; and second electrical connecting means for connecting the electrically conductive element to the ground element of the first electrical connecting means, the second electrical connecting means comprising (a) a tank contact on the tank electrically connectable with the electrically conductive element, the tank contact including a first metallic strap at the inlet duct to the tank, the first metallic strap being connectable to the helical wire of the electrically conductive element and (b) a lid contact on the lid connected with the grounding element, the lid contact including a circular metallic ring connected to the lower rim of the lid and placed for engaging the first metallic strap regardless of the orientation of the lid when the lid is on the tank to thereby complete electrical contact between the tank contact and the lid contact.

12. The dust collector of claim 11, wherein the inlet duct is formed in the tank.

13. The dust collector of claim 11, in which the tank is also of non-conductive material, and a second conductive strap extends along the tank to provide a low resistance path for any electrostatic charges which may build up on the tank, and the second strap is connected to the tank contact.

14. The dust collector of claim 13, wherein the second conductive strap is in the chamber.

15. The dust collector of claim 13, wherein the tank contact for the first and second conductive straps is the same.

16. The dust collector of claim 11, in which the suction means includes a motor and a suction fan driven by the motor; the electrical connecting means includes a three-prong plug, one of the prongs being adapted to be inserted into a ground receptacle; and the lid contact is electrically connected to the grounding prong.

17. The dust collector of claim 16, in which the lid includes a filter support element in communication with the chamber and with the suction means; and in which the lid further includes an outlet duct from the suction means, and the outlet duct is adapted to receive a dust collection bag.

* * * * *